US006305772B1

(12) United States Patent
Berkoben et al.

(10) Patent No.: US 6,305,772 B1
(45) Date of Patent: Oct. 23, 2001

(54) ANGLED AIR IMPINGMENT SYSTEM FOR DOCUMENT CONTROL

(75) Inventors: Kenneth Richard Berkoben, Plymouth; Robert Doldon Childress, Livonia; Sammy Cline Hutson, West Bloomfield; Carl Raymond Lohrmann, Canton; Robert Timothy Rourke, Troy; Ronald Lynn Upton, Brighton, all of MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/100,776

(22) Filed: Jun. 8, 1998

Related U.S. Application Data

(60) Provisional application No. 60/050,676, filed on Jun. 25, 1997.

(51) Int. Cl.[7] ..... B41J 3/00; B41J 2/165

(52) U.S. Cl. ..... 347/4; 347/34

(58) Field of Search ..... 347/4, 18, 82, 347/34, 8; 399/92, 93; 226/97; 364/478.11; 412/9; 271/14–18

(56) References Cited

U.S. PATENT DOCUMENTS

| | | | | |
|---|---|---|---|---|
| 4,033,807 | | 7/1977 | Neill et al. | 156/384 |
| 4,572,071 | | 2/1986 | Cappel et al. | 101/183 |
| 5,102,118 | | 4/1992 | Vits | 271/195 |
| 5,345,863 | * | 9/1994 | Kurata et al. | 347/4 |
| 5,479,242 | * | 12/1995 | Sato et al. | 347/92 |
| 5,530,523 | * | 6/1996 | Kawabata | 347/97 |
| 5,552,812 | * | 9/1996 | Ebinuma et al. | 347/34 |
| 5,655,449 | | 8/1997 | Henn et al. | 101/232 |
| 5,740,740 | | 4/1998 | Stephan | 101/483 |
| 5,782,183 | | 7/1998 | Andrews, Jr. | 101/232 |
| 5,860,781 | * | 1/1999 | Wiedemer | 412/9 |

* cited by examiner

*Primary Examiner*—John Barlow
*Assistant Examiner*—Charles W. Stewart, Jr.
(74) *Attorney, Agent, or Firm*—David G. Rasmussen; Mark T. Starr

(57) ABSTRACT

A document-endorse arrangement has a document transport mechanism wherein documents are advanced down a track past one or more print stations where a jet-print nozzle array projects an ink stream to the document. One or more angled air streams arise from the track. Each air stream is directed downstream of the track at an acute angle of approximately 20 degrees with respect to the track. At least one of the airstreams is upstream of the nozzles and is adapted to pneumatically float each document past the nozzles so as to maintain a prescribed gap between the document and both the track and nozzles. This inhibits contamination of the nozzle from surplus ink and dust.

16 Claims, 12 Drawing Sheets

ANGLED AIR IMPINGMENT SYSTEM FOR DOCUMENT CONTROL

This is a Continuation of my U.S. Provisional 60/050, 676, filed Jun. 25, 1997, and claims priority therefrom.

This case concerns ink jet printers and particularly those used in a document processing apparatus, e.g., to imprint a passing document.

BACKGROUND, FEATURES

Workers concerned with ink printers (endorsers) used to imprint flimsy documents (e.g., checks) on-the-fly, as they are advanced, transported quickly along a track past the print station are aware that jams are all too frequent. Yet such documents must be very precisely positioned as they are swept past the print head. Also, such systems often are characterized by "paper dust" that must be prevented from collecting on the wet print nozzles.

An object hereof is to address the foregoing. A related object is to provide a sheet transport with pneumatic guidance, especially around a sheet-imprint station. Another object is to do so for one or more jet-print endorser stations.

The following describes a related document transport mechanism utilizing an "air impingement" system to pneumatically advance documents along a track and to accomplish a number of related things: e.g., keep dust off an ink jet endorser system, to control the gap between the endorser and a passing document, to provide document position control at a gap in the wall of the transport track, to prevent the freshly-endorsed document from smearing ink onto the transport wall, and to accelerate the drying of document print ink—especially in a document processing machine such as a Unisys NDP-575, -1000 (Networked Document Processor), a DP500, (by Unisys Corp., Blue Bell, Pa.) or other like machine. Thus, an object hereof is to alleviate (at least some of) the foregoing problems and to provide associated advantages. A more particular object is to use a novel air-impingement system to keep dust off ink jet nozzles. A related object is to use such to help control document positioning relative to the ink jet.

A further object is to help dry so-imprinted ink images on a passing document, and keep the document from smearing its ink-print against a nearby track wall.

BRIEF DESCRIPTION OF THE DRAWINGS

These and other features and advantages of the present invention will be appreciated by workers as they become better understood by reference to the following detailed description of present preferred embodiments, which should be considered in conjunction with the accompanying drawings, wherein like reference symbols denote like elements:

FIG. 6 shows, in exploded view, the parts of a preferred blower-distributor arrangement for the above; while

MORE BACKGROUND

The laws of fluid dynamics indicate that passing high velocity air over one side of a target sheet surface, while the air on the other side of the surface is moving slower (e.g., is stagnant), will create a force on the slower/stagnant side that will try to move that surface toward the high velocity air stream (e.g. using the Bernoulli Effect,—this in an attempt to equalize total air pressure on both sides of the document), where the total pressure, P(t), is equal to the sum of the static pressure P(s) plus the velocity pressure head, P(v). Therefore, static air pressure ($P_s$–s) on the stagnant air side is a function of the total pressure $P_t$, [$P_t$~$P_{s-g}$], while the static pressure on the side with moving air ($P_s$–m) is equal to the total pressure $P_t$ less the velocity pressure head $P_v$.[$P_{s-m}$=$P_t$–$P_v$] This difference produces a force F against the stagnant surface where:

$$F=(P(s)-P(v)) * A(s), \text{ where:}$$

A(s) is the Area of the surface where the velocity differential exists. The velocity pressure head $P_v$ does not act against the surface; it has a vector parallel to the surface.

We propose to use this effect to control the position of a moving document as it passes an endorser, and beyond, for a number of inches downstream.

DETAILS OF PREFERRED EMBODIMENT

Figure 1:
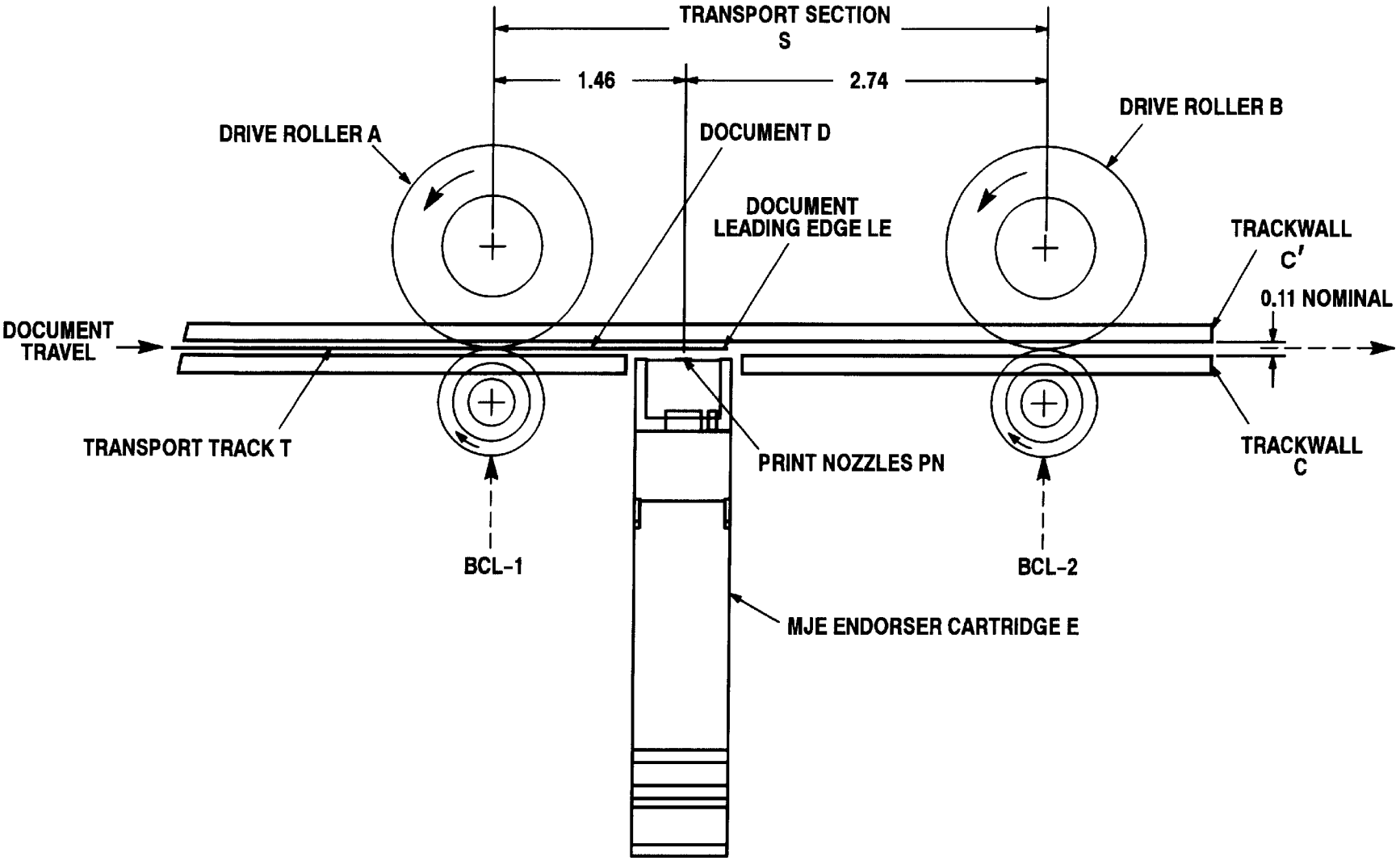
FIG. 1 is a sectional showing of such a document endorser station positioned along a transport track, with FIG. 2 showing likely jam points for such an array.

As depicted in FIG. 1, the leading edge LE of a document D (e.g., a check) traveling down a transport track T (e.g., in a UNISYS NDP575 machine) at 100 ips (inches per second) is assumed to leave drive roller A 1.46 inches before (i.e. upstream of) it reaches the endorser E—it doesn't reach roller B until 2.74 inches past (downstream of) the endorser. The NDP575 is a high-speed, automatic check processing machine sold by Unisys Corporation.

Along this transport segment S (from A to B), the document D is constrained by track walls C, C' (see FIG. 1) which are spaced apart a nominal 0.11 inches (trick width, $W_t$) and are designed to present no obstruction that might catch a document edge as it is pushed from roller A to roller B. As a feature hereof, we find that the document jam rate will increase as the track width $W_t$ (between the transport walls) decreases below about 0.10 inches (e.g. due to folds, wrinkles, tears, and staples that effectively increase the document thickness significantly above a nominal 0.007 inch, [e.g., here assume a document like a check that is about 0.007" (7 mil) thick by about 4.575–10 inches long by about 2.5–4 inch high, and is transported at about 100 ips., in an NDP575 type machine].

The jam rate (see potential jam points; jP, FIG. 2) will also increase as the track width increases above 0.110"—(this might allow the leading edge of a document to impact a wall at an angle steep enough to catch and slow the document, or to start urging edge LE to fold back). This also applies when openings in the track wall allow a document edge to "catch".

Thus, for such a situation (e.g., with walls C,C' about 110 mils apart), we find—as a feature hereof—there is an optimum, min-jam track width (here about 100–120 mils for a nominal 7 mil thick document).

Here, we prefer to assume the following use context: a MJE (Multi Jet Endorser), apparatus, such as in a NDP575 document processor (by Unisys Corp.), or the like—e.g., that has a 0.250 to 0.080 inch maximum gap from the front of the endorser nozzles to the document, for clear and consistent printing and requires that the document not be allowed to contact the nozzles (since this could cause jams and/or ink smearing).

This 25–80 mil gap constraint is for the NDP575 printers different printers will call for their own gap settings.

Figure 2:
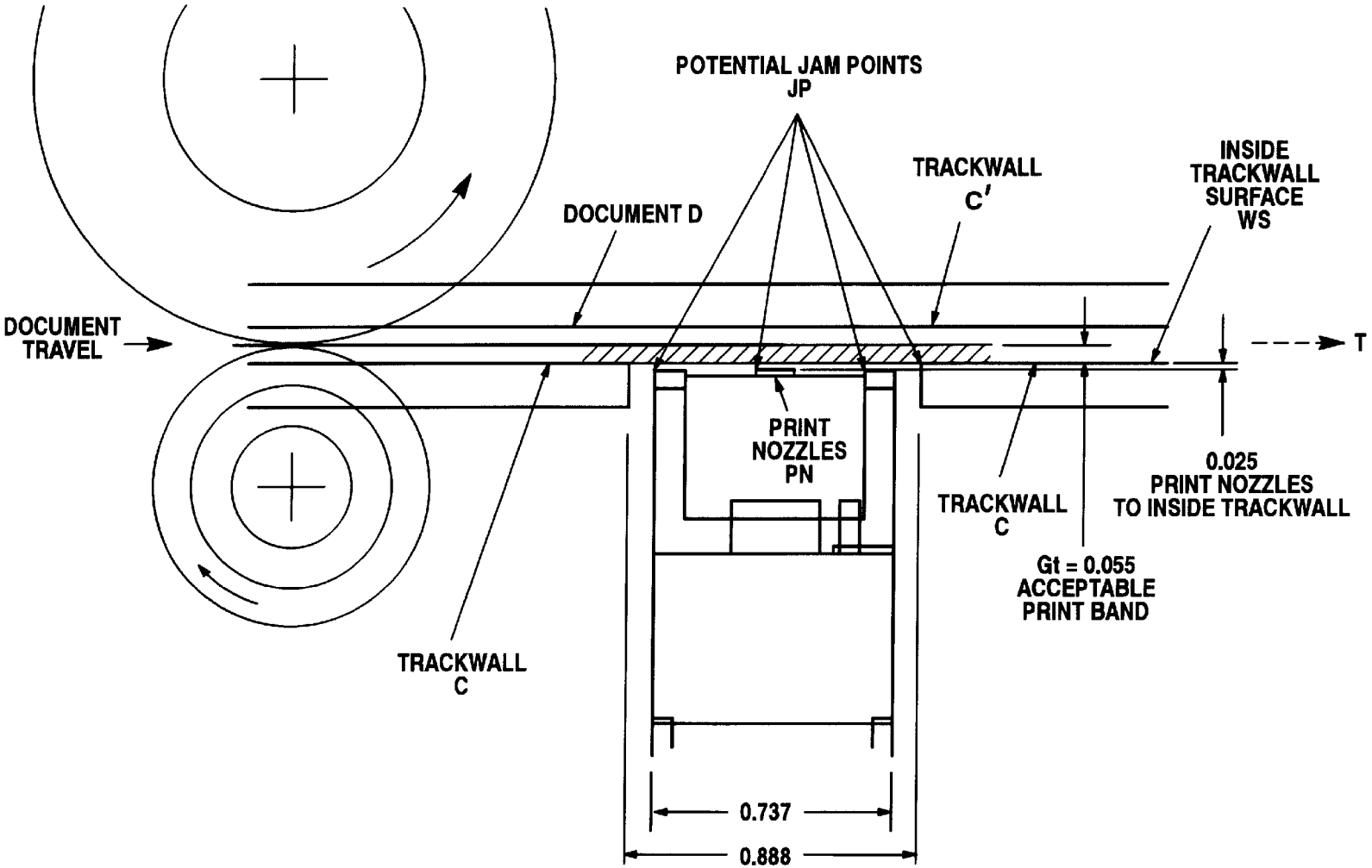

For optimum printing, we find that a subject document D should be between 0.025 and 0.080 inches from the nozzles (see PN, FIG. 2), which means that the document should be held within a 0.055 inch wide track-width-gap $G_T$ when passing the endorser. This narrow nozzle-to-doc't gap range also forces the "head" of the endorser cartridge to be placed within 0.025 inches of the plane defining the inside wall surface WS (FIG. 2). Surface WS is apt to be rough and present edges for the document to snag on, as shown in FIG. 2. But using conventional methods to constrain the document would likely produce an unacceptable jam rate. Thus, the need for this invention; using air jets to guide the passing check.

Other Sources of "Wall Snag":

In addition, the endorser print head has print nozzles PN, (FIG. 2) is 0.737 inches wide—This, plus the addition of clearance for installation, plus allowances for tolerances on the mating parts, forces the opening 0—0 in the track wall, where the endorser E is mounted to be 0.8 88 inches wide. Operating with such a large wall-opening, and with mere conventional document control techniques, would produce an unacceptable number of jams, even with documents in "good" condition. Thus, preventing, or minimizing such jams is an object hereof, especially via "air-jet directors".

Dust Problems:

All paper handling systems tend to generate a good deal of "paper dust" when moving and processing paper. If such dust is allowed to collect on a wet surface, such as on nozzles PN on the MJE endorser, it will soon distort the printing, eventually making the print unreadable. This would cause a machine operator to stop the document feed too frequently (to clean dust from the nozzle end of the endorser).

A solution: Upstream Air-injection (FIGS. 3,4):

To address such problems—and as a salient feature hereof—we have developed pneumatic document transport arrangement or "jet director", for such an endorser E that introduces an air stream at a 20 degree angle (+/−2°) to the track axis (document direction), located 0.96 inches upstream of the endorser E—this producing a flow of "low velocity air" past the print head (nozzles PN). This air stream (as illustrated in FIG. 3) is relatively free of paper dust when compared to the free ambient air within the track T; and this greatly reduces the build up of dust in the ink on the end of the endorser nozzles—but, principally, it must be a sufficiently "gentle", Lo CFM flow, so as not to upset jet printing (cf. The trajectory of droplets onto document).

Figure 3:
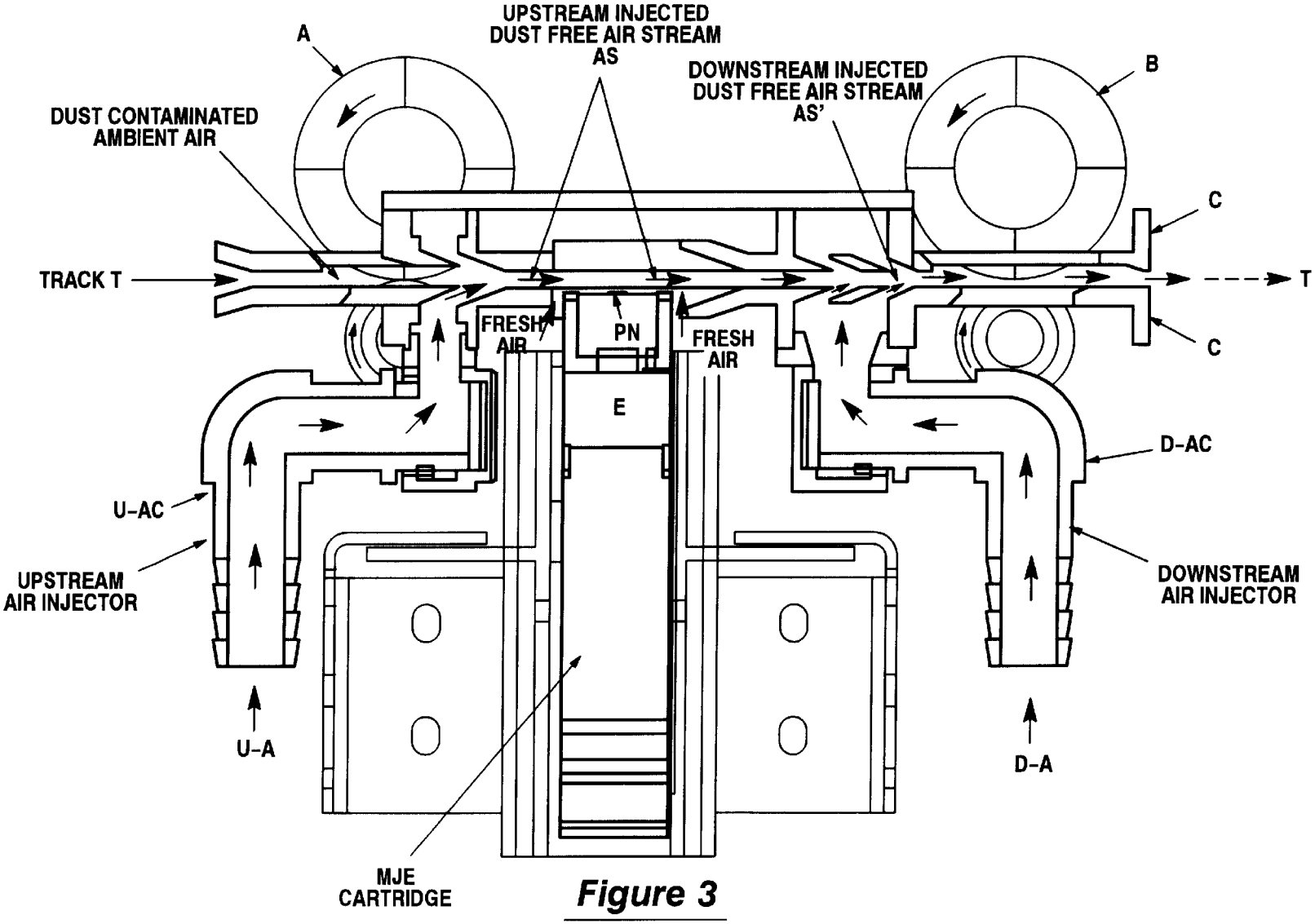
FIGS. 3, 3A, 3B illustrate, in section, such an endorser fitted with two air-injector impingement transport means according to a preferred embodiment; while FIG. 4 gives an enlarged sectional view of one such air injector, indicating associated typical pressures on a passing document.

Further, this accelerated moving air stream also acts as a jet pump which pulls relatively fresh air (into the track through the opening as illustrated in FIG. 3) on either side of the endorser. With this system, any need for the operator to stop the machine and clean the endorser is reduced to an acceptable level.

Figure 3A:
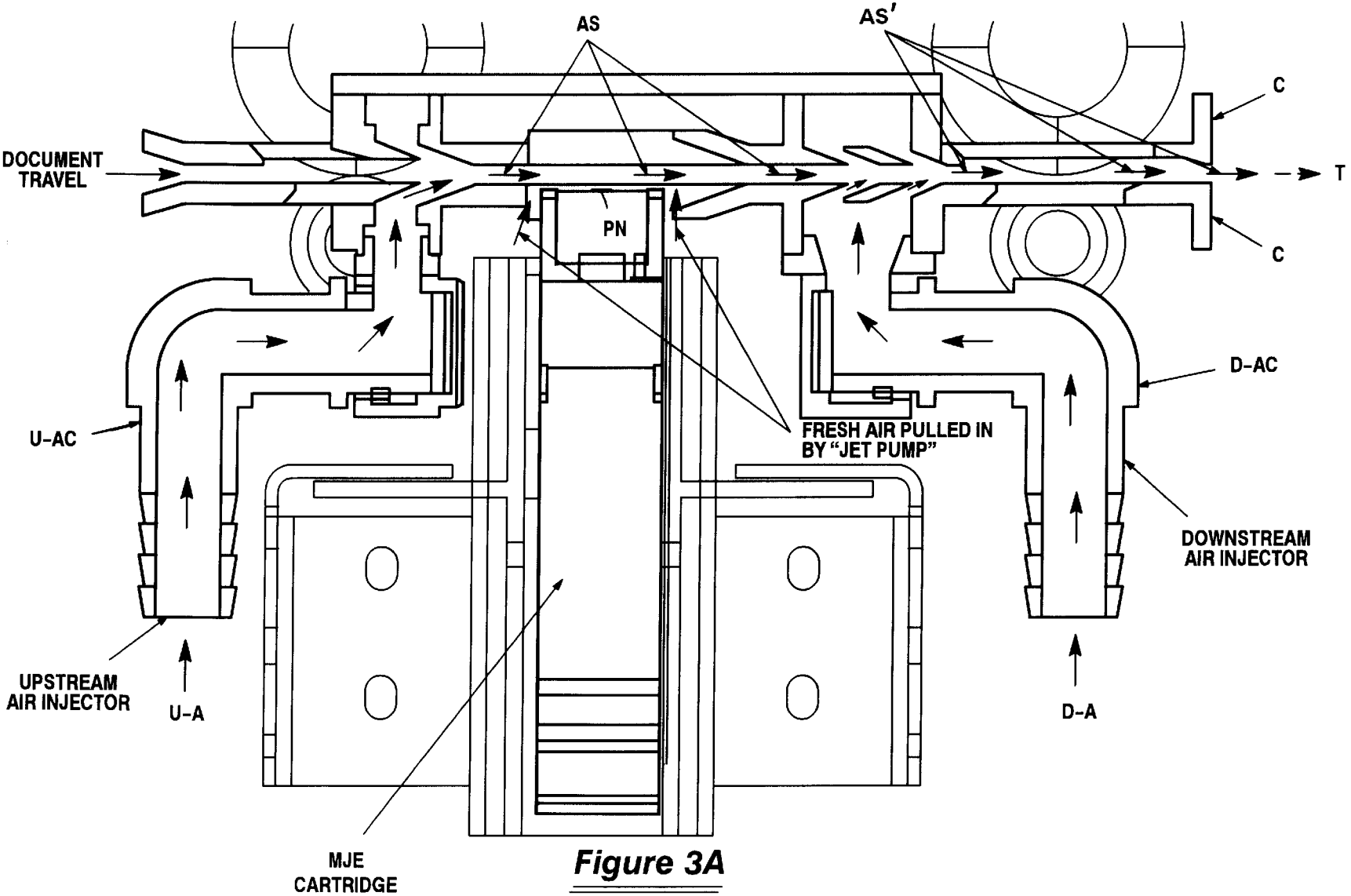

And, as a supplemental feature, a second (downstream) air injection is preferably added (on the endorsement side of the check) downstream ( e.g., 1.54" downstream from the endorser E) to introduce more air ( stream AS' FIG. 3) to continue the flow down along track T, as shown in FIG. 3 [please note FIGS. 3 and 3A and both air-streams, AS, AS': upstream and downstream flows, both, lie only on endorse-head side of check]

Figure 4:
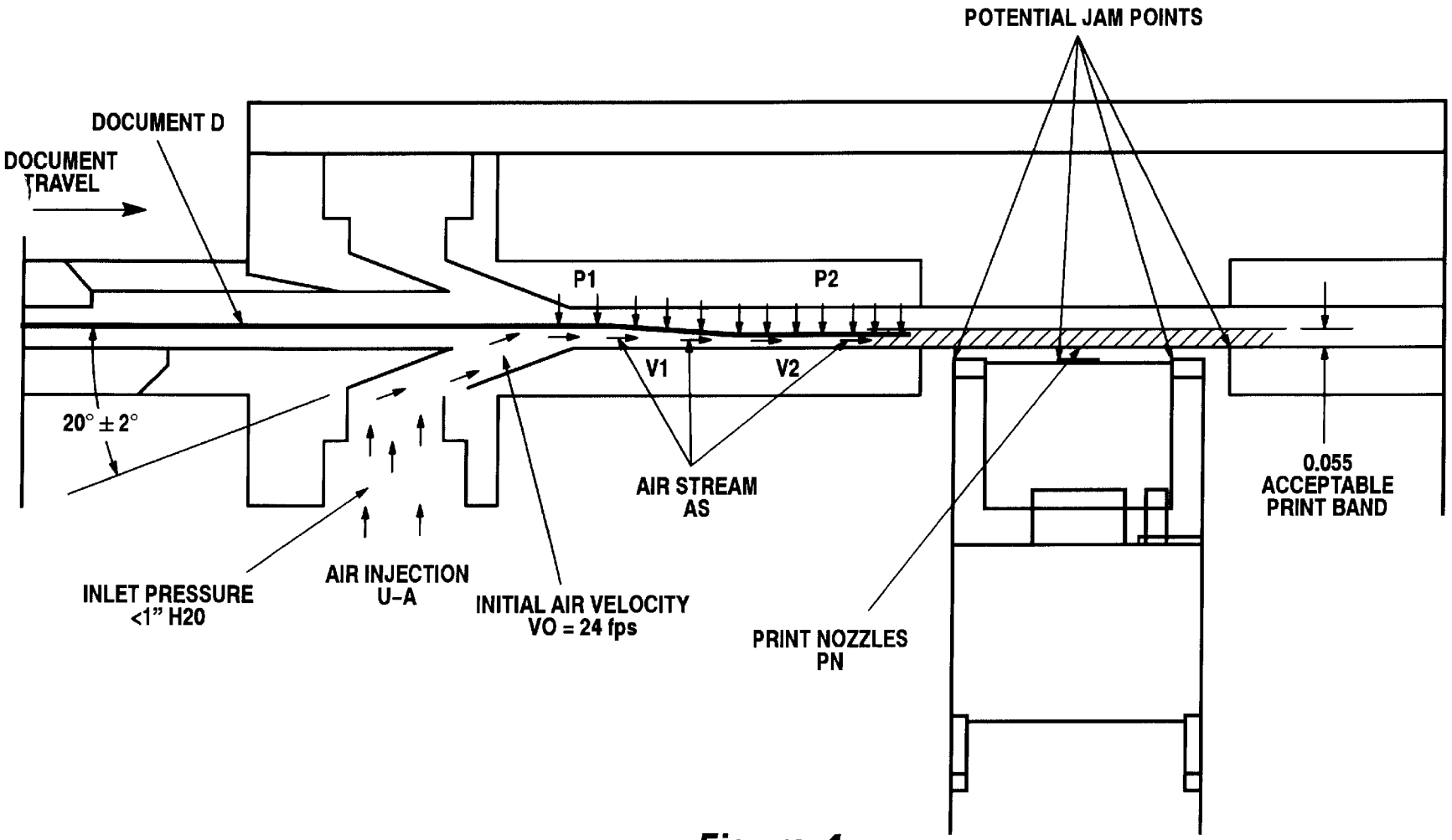

Fluid Dynamics:

We believe that when a document coming down the track enters the upstream injected air stream, the document divides the stream flow, with the air stream restricted to one side of the document (shown in FIG. 3) where document shown dividing the air stream). With cross-sectional flow area confined to the endorser side of the document, the velocity of the air increases there, (following the law of conservation of momentum), thus reducing pressure there. This increase in velocity decreases the differential pressure on that side of the document, to thus urge the document closer to the endorser side (of track wall WS), with the document is being held off that wall only by a cushion of moving air, as shown in FIG. 4.

This air cushion assures that the document can pass the open track wall in front of the endorser without catching and jamming. Since the actual track wall gap has not been reduced, there is nothing for staples, folds, tears or wrinkles to catch on, and the jam rate of the machine is not increased.

The air flow rate and injection angle (pref. 20 degrees) of the air were selected to produce forces that hold the document within the desired spacing (gap) to the endorser. If the air injection angle is increased much above 20 degrees, the air impacts the document at too steep an angle, undesirably deflecting the document toward the opposite trackwall. As the angle of injection becomes steeper, a portion of the injected air will flow upstream (in the wrong direction) reducing effectiveness downstream of the injector. Injection angles much below 20 degrees, while desirable, are relatively impractical due to limitations in the manufacturing process.

With the injection angle set at 20 degrees, the velocity of the injected air and the air flow rates become the next variables to fix. High air flow rates will provide better position control of the document but must be limited, in the NDP575 MJE endorser application, to avoid affecting the endorsement. The velocity of the air stream on the endorser side of the document has to be carefully controlled to avoid "blowing" drops of ink (being projected from the endorser nozzles) out of position and distorting the print on the document. Once the optimum velocity is selected, the air flow rate and inlet, pressures become a function of the injector nozzle cross sectional area and the capacity of the air supply. Here, low CFM (Cubic Feet per Minute) stream is preferably at an inlet pressure of under 1 inch of water, yielding an initial inlet air velocity of 24±5 feet per second.

The second, HI CFM, injected air flow (down stream of the endorser) injects air at a higher rate (e.g., here pref. 3.05 to 3.93 CFM at 63.5±9.5 feet per second velocity). This increased air flow rate and velocity is achieved with only a small increase in inlet pressure (under 1.5 inch of water) by increasing the inlet area (3 times) and providing less restrictions in the flow path from the blower. This helps insure that the passing document, with it's "still-wet" endorsement, is held off the track wall until the document is engaged by roller B, (nominally at the centerline of the track). This higher volume of air serves a second purpose too: it speeds the drying of the ink printing, and reduces the risk of smearing after the document leaves the "air-controlled section" of track T (i.e., between advance rolls A, B).

Here, we assume that the documents (e.g. checks about 5.75" to 9" long) will always be longer than the distance between rollers A, B, which drive documents at about 100"/sec. For good system control, we prefer to use optical sensors to track document advance; e.g. with a first BOL (beam-of-light) sensor BOL-1 roughly at drive roller A and a second, BOL-2, at drive roller B (see FIG. 1). Thus, for instance BOL-1 cm signal "Here comes a document" when a leading edge crosses (e.g. to accelerate rollers A, B, to activate endorser E, etc., and BOL-2 can do likewise for a second downstream endorser. And, control software can use the BOL signals to verify where a document is, whether it is moving (fast enough, e.g. vs a jam—in which case the transport can be shut down), etc. And appropriate software can be used to control printing (e.g. giving margins at both ends of a document, despite change in document length).

Figure 5:
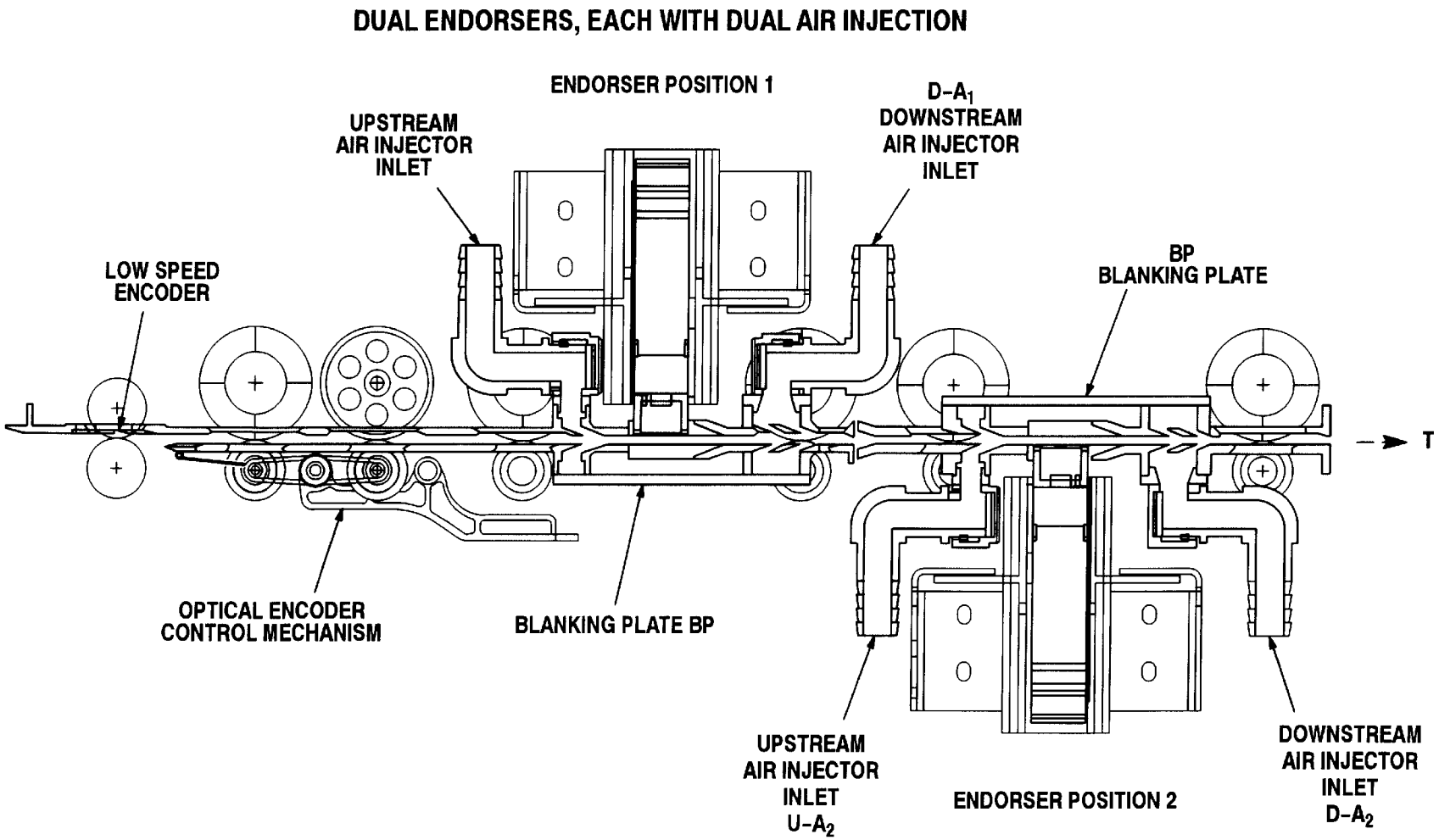
FIGS. 5, 5A are a showing like FIG. 3, but with a pair of such endorsers and associated air-injectors.

As shown in FIG. 5, a preferred final system (designed especially for the NDP575 Document Processor) has two endorser stations, each with its own dual (upstream, downstream) air injection, i.e., one station at pos. #1 on left of track, the other at pos. #2 on right of track. The spacing between the endorsers will be made sufficient to eliminate the possibility of the air streams at one station interfering with those of the other.

Control of a document D at endorser position # 1 (as per FIG. 5) presents an added degree of difficulty for conventional document handling systems since the document entering that endorse station can be subjected to sudden acceleration (from 7 ips to 100 ips in the NDP575)—cf. as the trailing edge of the document leaves the low speed encoder and is accelerated to normal track speed. Our air injection system successfully controls the document under these conditions, since the pressure differential across the document is independent of document speed.

This system is designed so that the endorser and dual-air system at position #1 (see FIG. 5A) can be installed on either side of the track and can also accommodate "single-endorser" mode, with a blanking plate BP installed over the mounting bosses for the air system on the opposite of the track from the installed endorser.

Figure 6:
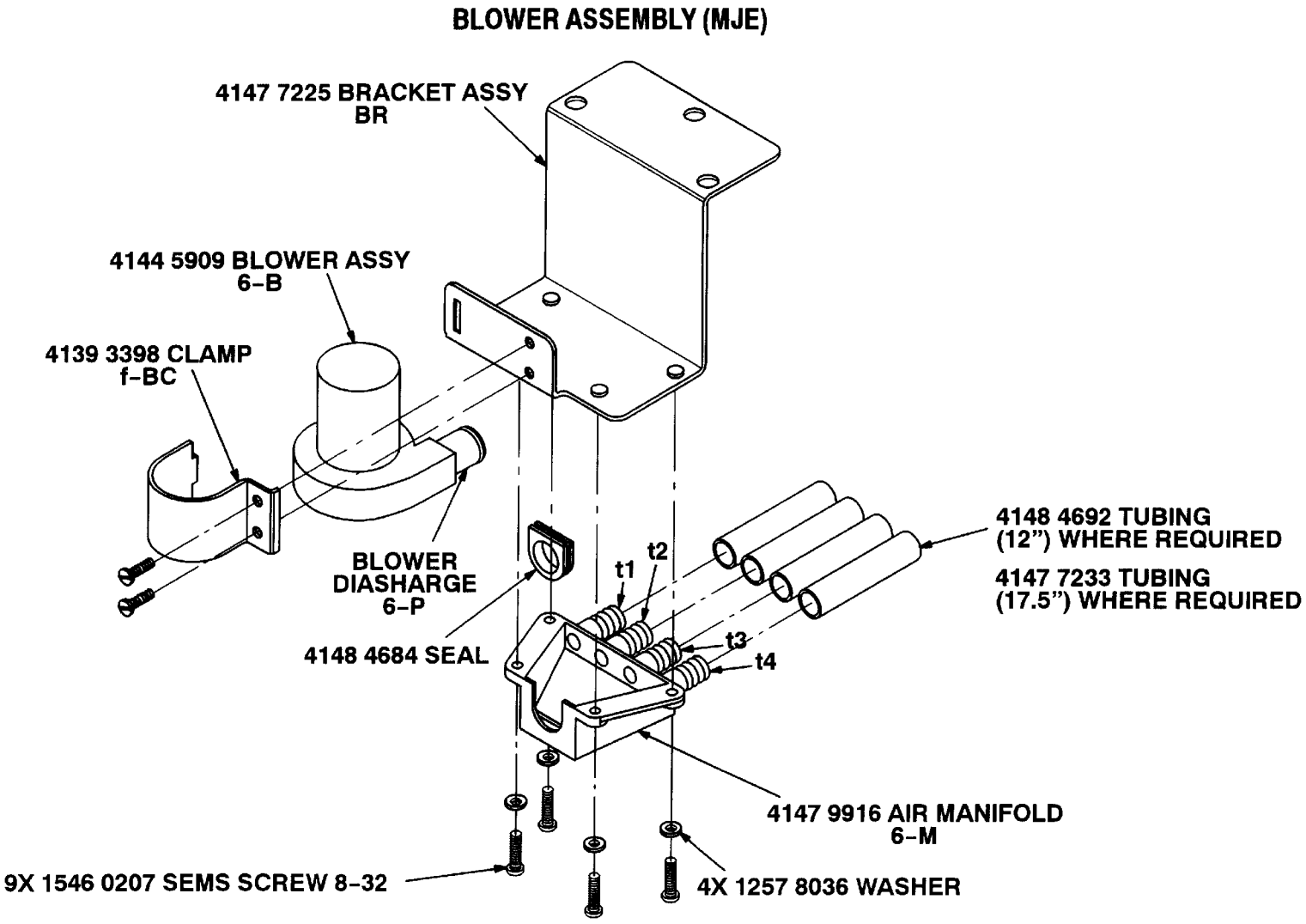

Preferably, a single blower is used as air-source to supply air to both the upstream and downstream air systems on both endorsers, and it also preferably uses a manifold (e.g., 6-M, FIGS. 6, 7) specially designed to control the ratio of upstream to downstream air, and to also provide airflow to either, or both, endorsers, within the required flow range—whether or not one or both endorsers are present. This is accomplished, as shown in FIG. 6, preferably by using a centrifugal blower 6-B with specific operating parameters, and which presents a discharge port 6-P at the apex of a "flattened triangular" shaped manifold 6-M. Manifold 6-M preferably presents four discharge ports $t_1$–$t_4$, spaced across the manifold base.

The discharge from such a blower creates a local high pressure area around the two center discharge ports (e.g., $t_2$, $t_3$ FIG. 7) where the air stream strikes the base of the manifold (for "upstream" air), and lower pressure at the "outside" discharge ports $t_1$, $t_4$) which are connected to downstream air injection systems (e.g., as in FIG. 7A, 7B) on the two endorser (stations) tracks. The combination of the higher pressure at the manifold center ports (see flow restrictors built into the outside discharge ports) and the size of the air injection slots (on one side of the track wall) can produce the desired air flow rates of about 3.05 CFM and 0.68 CFM respectively (i.e., Hi-CFM, Lo-CFM) through the downstream and upstream injection systems.

Figure 7:
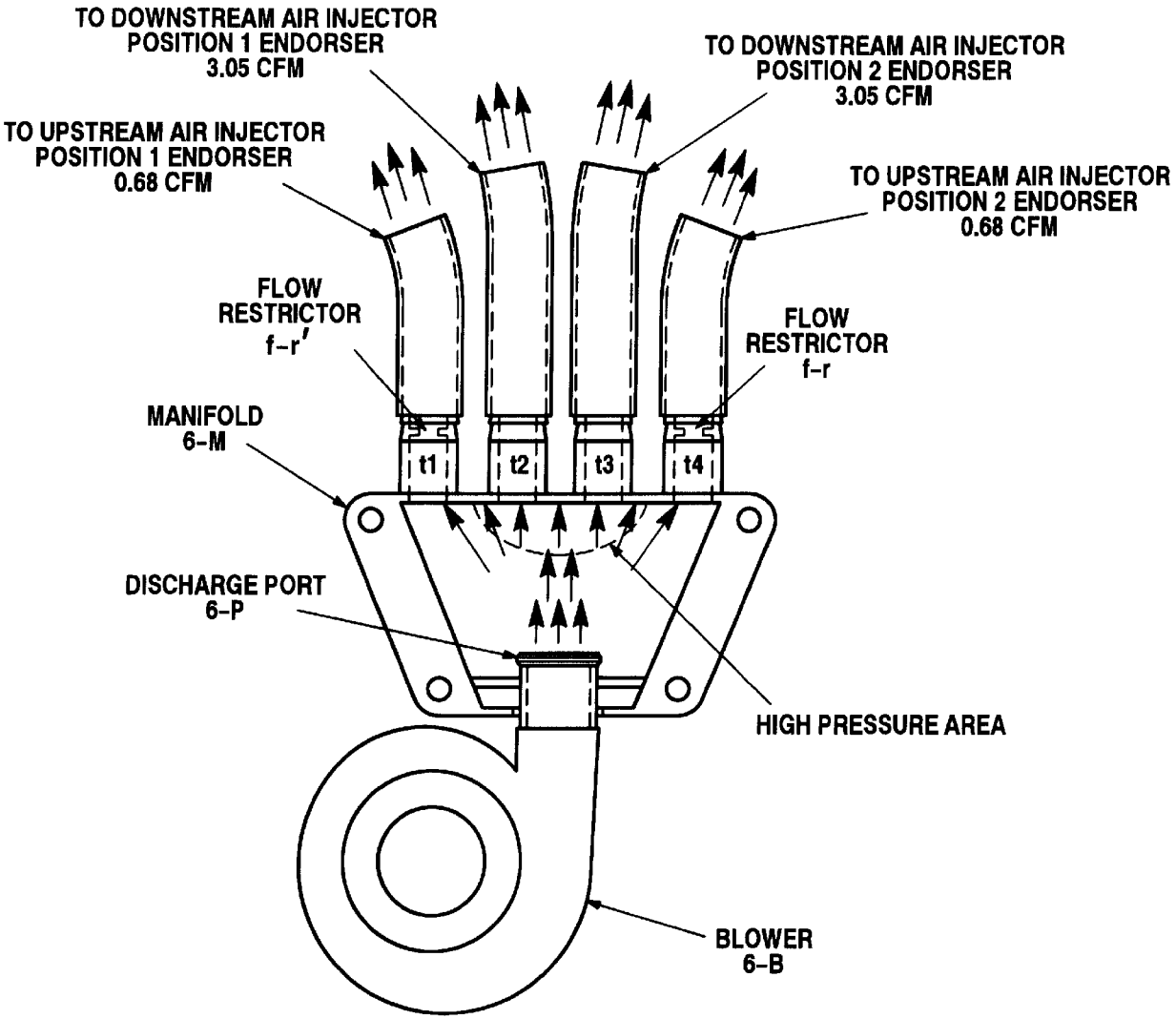
FIGS. 7, 7A and 8 show the same, assembled, with two ports capped in FIG. 8.
Figure 7A:
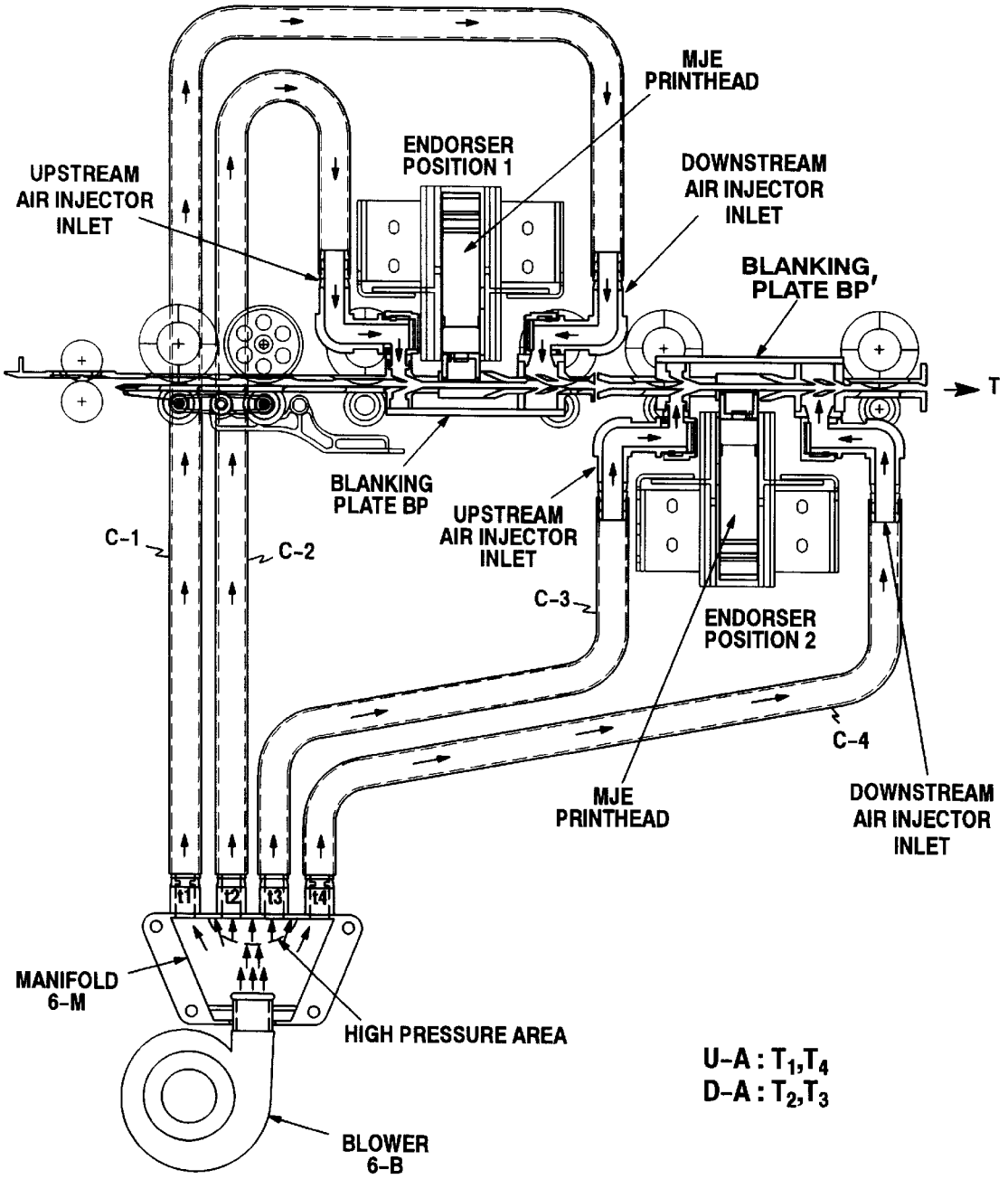
Figure 8:
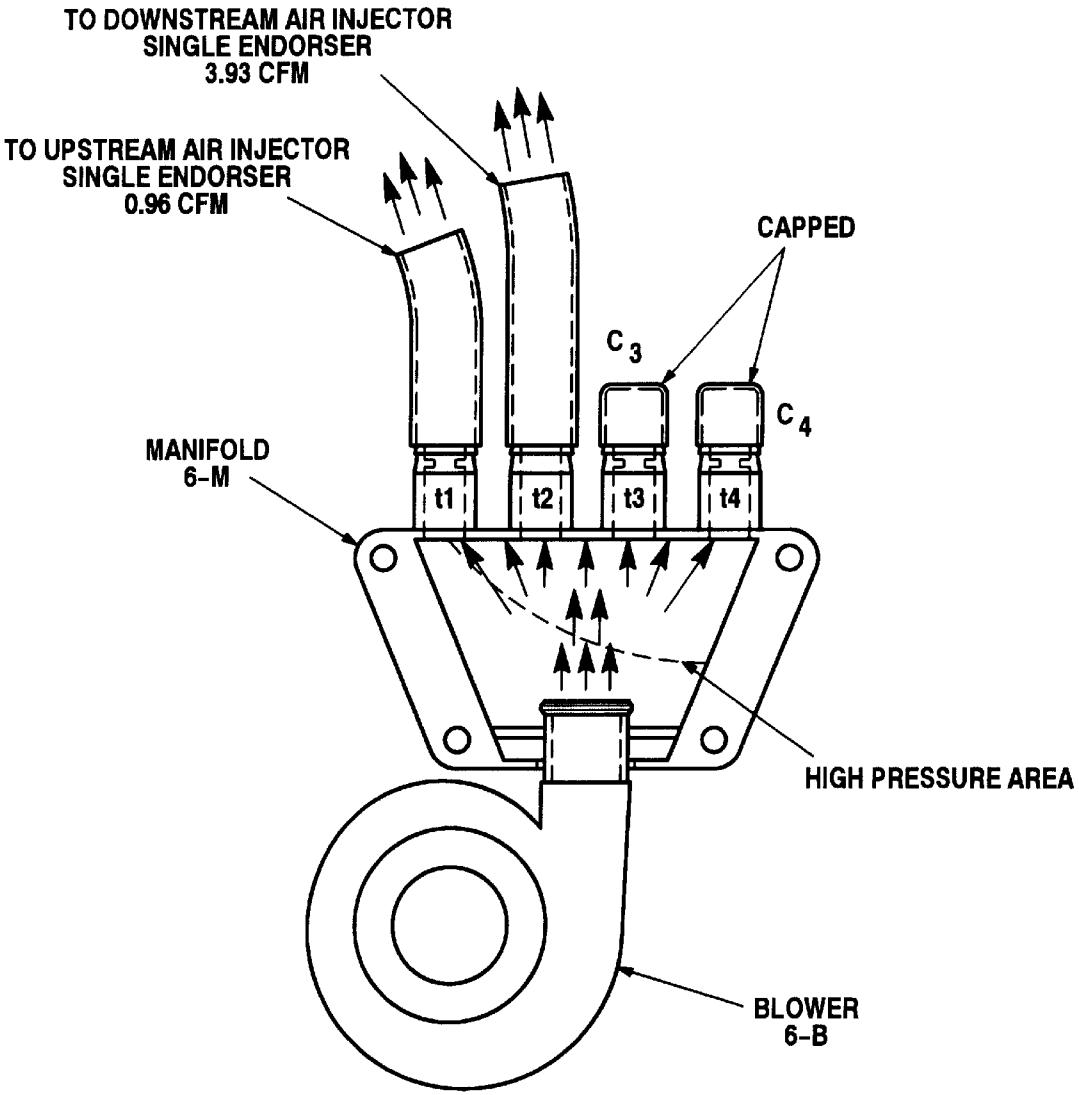

In FIGS. 7–8, it will be understood that pressures/flow is controlled (e.g. via restrictors f-r, etc.) to send a low CFM flow out the two "end-tubes", $T_1$, $T_4$ (e.g. preferably for "upstream flow" U-A, etc.) with intermediate tubes $T_2$, $T_3$ distributing a higher CFM/velocity (e.g. preferably for downstream flow" D-A, etc). Thus, in FIG. 7A, although related conduits C-1, C-4 appear coupled for "downstream flow" and conduits C-2, C-3 appear coupled for "upstream flow" (and associated restrictors can accommodate this: e.g. dropping the flow from $T_2$, $T_3$ to exhibit the low CFM of a desirable "upstream flow" via conduits C-2, C-3, with tubes $T_1$, $T_4$ carrying higher CFM for downstream flow, via conduits C-4, C-1)—the array can be readily re-arranged, with restrictors limiting output at $T_1$, $T_3$ to low CFM, and hi CFM at C-2, C4—so, accordingly, "upstream conduits" C-2, C-3 will be coupled to Lo CFM tubes $T_2$, $T_3$ respectively, and "downstream conduits" C-1, C-4 will be coupled to Hi CFM tubes $T_1$, $T_4$ respectively.

This, illustrates the versatility of such arrangements (e.g. if $T_2$, $T_3$ were made to deliver Hi CFM, they would be coupled to conduits C-1, C-4, while if $T_1$, $T_4$ delivered Lo CFM, they would be coupled to conduits C-2, C-3).

The centrifugal blower 6-B preferred for this system has an "Airflow vs. Back pressure" curve that allows one outside port and one center discharge port of manifold 6-M to be capped when there is only one endorser (as in FIG. 8). The airflow from the remaining center and outside discharge ports will only rise to 3.93 CFM and 0.96 CFM, respectively, under these conditions, as shown in FIG. 8.

This is achieved because the reduced flow area, with two blocked discharge ports (e.g., see caps on $t_3$, $t_4$), increases the total pressure within the manifold 6-M as suggested in FIG. 8—and resultant "back pressure" on the blower is found to reduce it's efficiency (and output) to about 65% of that achieved with four open discharge ports.

The use of this single blower system to provide (Hi, Lo CFM) air to both the upstream and downstream injectors of either, or both, endorsers greatly reduces the manufacturing complexity of this MJE Endorser system; it also minimizes the material and labor costs of the air system. An additional benefit is the ease of adjusting and upgrading the system in the field, since only two caps have to be removed and two hoses connected to complete the air system hookup to convert to a "two endorser" operation (from single endorser).

Recapitulating Functions:

Workers will appreciate that, in general, the foregoing teaches techniques for advancing and directing documents, etc. along a track T (e.g. see FIG. 1) past one or more endorse stations, with one or more "angled air streams" to help position and guide them.

Figure 3B:
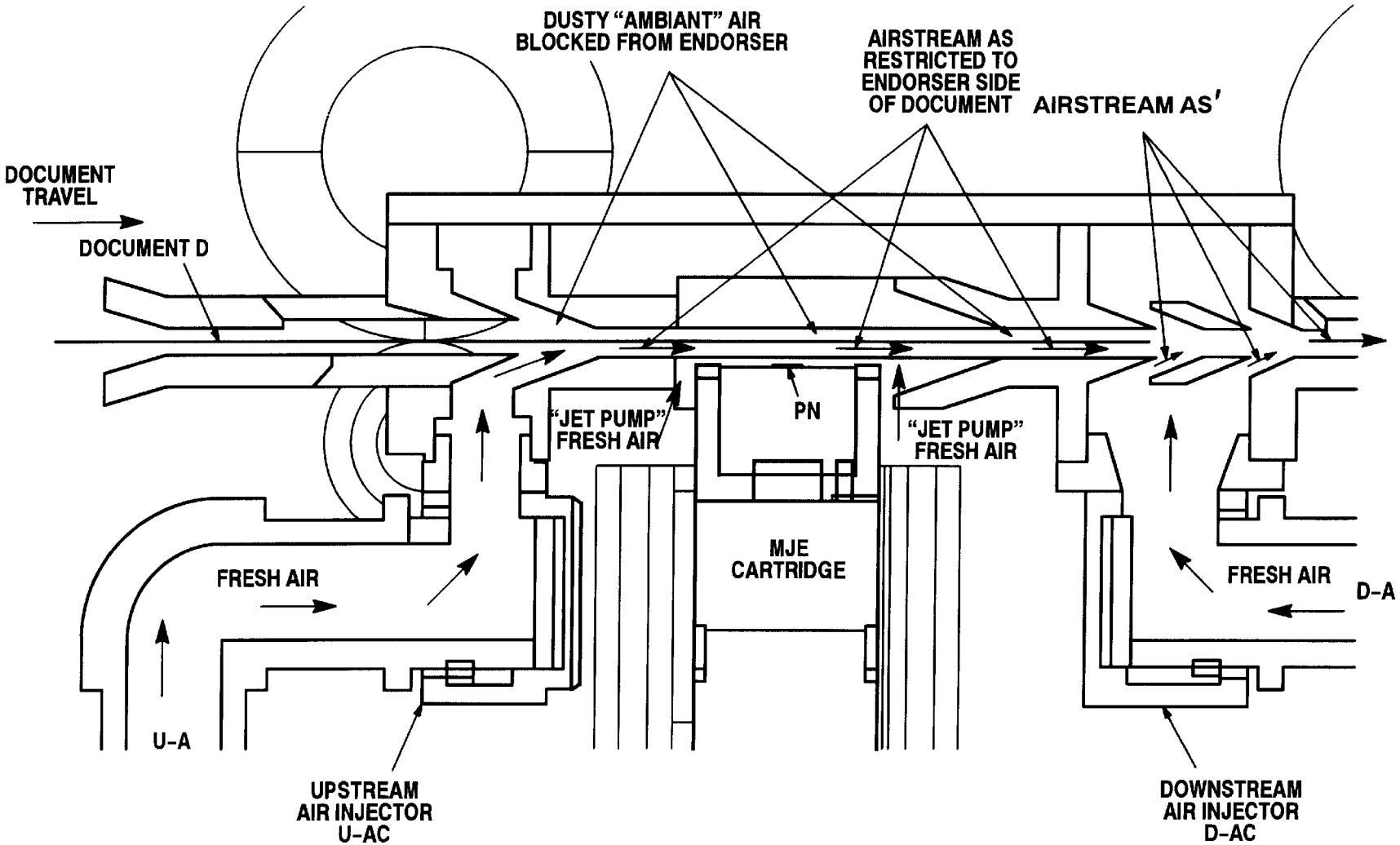

For instance, FIGS. 3, 3A, 3B show means for injecting such a stream upstream of an endorser E (see "upstream air, U-A") and also downstream thereof (see "downstream air, D-A").

FIG. 4 shows idealized pressures/flow for a stream U-A, with associated document positioning (e.g. relative to nozzles PN).

Figure 5A:
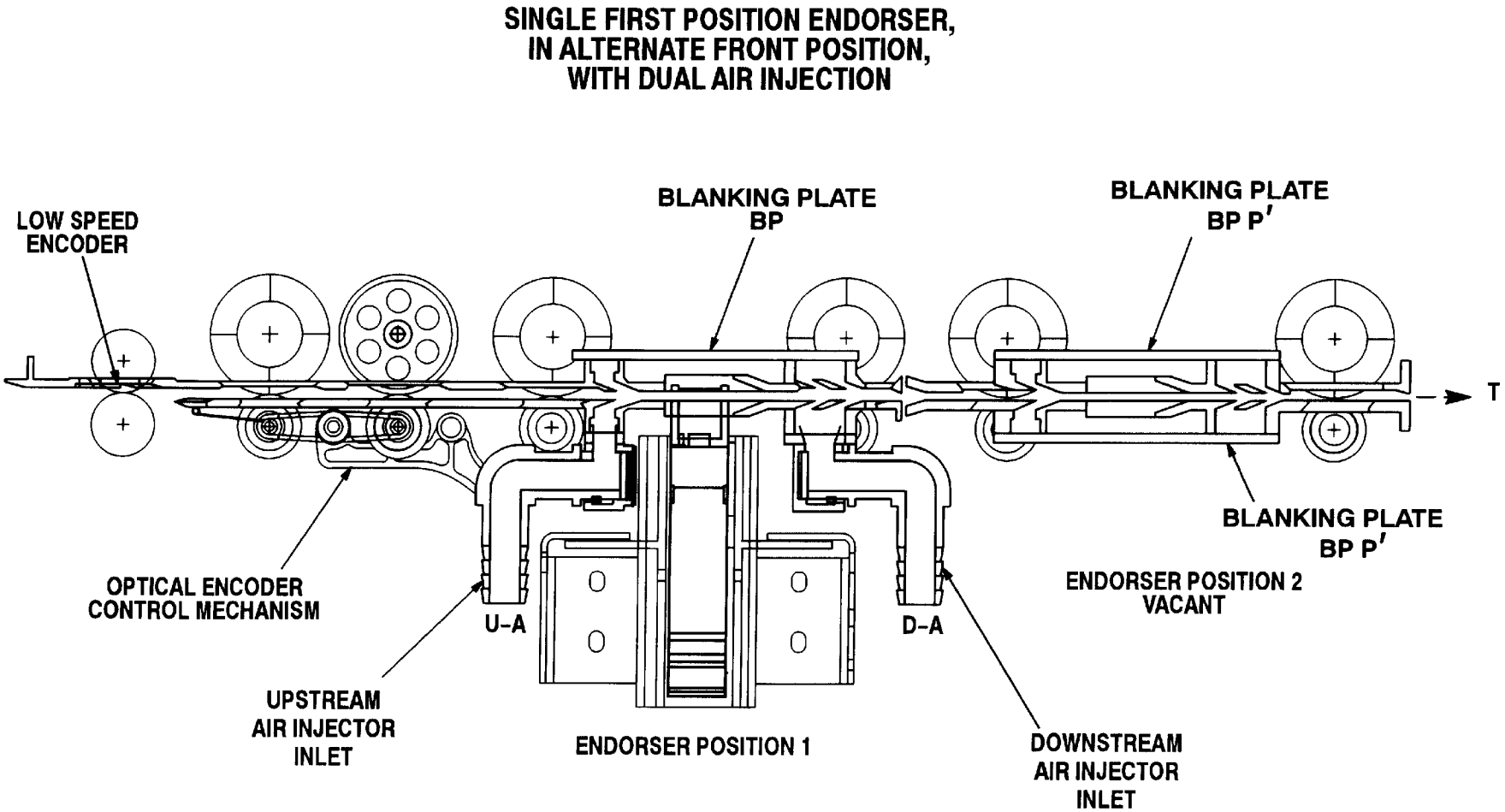

FIG. 5 shows a pair of such endorser stations, each with its pair of injectors (see $UA_1$, $DA_1$, and $UA_2$, $DA_2$); while FIG. 5A shows the "first" endorser/air inject combination switched to the other side of track T, with a blank-plate covering "unused inlets".

FIGS. 6–8 show a "4-way manifold" etc. for distributing upstream/downstream air past two endorse stations, with FIG. 7 indicating the use of restrictors to adjust upstream/downstream flow and FIG. 7A indicating related flow paths, while FIG. 8 indicates "capping" of one pair of such airstreams FIG. 5 also suggests how an endorser can be "switched" to the opposite side of Track T, and indicates that, when air-inject conduits are also so-switched, they will leave air-inlets that should be covered (e.g. with blanking plates BP, BP').

Structure:

The preferred structure for implementing the foregoing was already suggested (and should now be evident from FIGS. 1–8) but will be summarized as follows. In FIGS. 3, 3A, 3B upstream air AS is injected via an associated conduit U-AC and downstream air AS' via conduit U-DC, with inject nozzles "angled down the track" as mentioned.

In FIG. 5 the endorser/conduit structures are "twinned" and otherwise as above, with blanking plates BP, BP' preferably disposed opposite each pair to cover upstream/downstream inject inlets.

As a preferred feature, each upstream flow is preferably made relatively "Low CFM/Low velocity", while each "downstream" flow is preferably given increased CFM/velocity. In simpler versions this differential CFM/velocity can be approximated with adjustment of simple restrictor means (e.g. f-r, f-r', FIG. 7). And, where a two-endorser array is projected, it may be modified to leave one endorser station missing, preferably by simply inserting associated blanking plates BPP, BPP' to seal-off air-inlets therefor (see FIG. 5A).

And, where a blower/manifold arrangement is preferred for supplying various pairs of upstream/downstream air, workers may adopt those taught by the embodiments of FIGS. 6–8 plus associated mount means and tubing. When our preferred array is used (e.g. as in FIGS. 6–8), such tubing may be supplied with simple flow restrictor means (see f-r, f-r' with FIG. 7) to impart a desired High/Low distribution of air flow (e.g. as in FIG. 7, Low CFM at outer tubes, High CFM at inner tubes)—with appropriate tubular connections to each endorse station, as in FIG. 7A.

FIG. 8 indicates how such a blower/manifold may readily be modified (via caps $C_3$, $C_4$) to accommodate a single-endorser system.

Resume:

Workers will appreciate that the foregoing makes plain that our novel "air-impingement" document-directing/transport system can advantageously be incorporated in an ink jet print arrangement to, among other things, keep dust from the jet nozzles, help dry the imprinting, help position the subject print-document more precisely, (though pneumatically), at the print head, and prevent the document from contacting a track wall and then smearing its printing.

An additional, unexpected benefit of this air system is the control of the minute ink droplets that are generated each time an endorser fires a drop of ink at the paper. "Surplus" (non-imprinting) droplets are suspended in the air around the endorser and slowly settle on everything in the general area. With our subject air injection system, such "surplus" droplets are carried downstream and settle on the track walls in a uniform and consistent "wake" pattern. By positioning the document transport BOLs (Beam of Light document sensors) outside this "wake", the need to frequently clean things is greatly reduced.

An additional application for this air system would be to control the dispersal pattern of the product or residue of any device that generates a fine mist or dust that might otherwise float randomly into an unwanted position.

Other potential uses include:

Providing "clean" air wash over other BOLs in the NDP575, or any document transport, to prevent paper dust or other contaminates from building up and obstructing the light path.

Providing "clean" air wash over glass track walls as used in Microfilmers and Imaging systems (e.g. in UNISYS Document Processors).

Providing document position control for Microfilmer and Imaging systems to improve resolution or to prevent smearing of ink, dust, or any other contaminants on the glass viewing area.

Providing document (or fabric) position control in any device, that requires precise positioning for printing, viewing or scanning, when there is reason to not physically touch the object (e.g. due to wet ink or dye) or where the document must enter a restricted area. Our subject air injection system can be coupled with an active control system that senses position and increases or decreases air flow or injection angle for improved precision of positioning.

Our air injection position control system can be used for: Letter sorting, scanning, endorsing or canceling devices, or printers for any size paper or other thin lightweight material (both sides could be printed at the same time without worrying about touching and smearing the other side.)

Salient novel features mentioned can provide:

1—A sheet endorser (e.g., jet-print) along a track with jet-flow, that:

- 1a—is placed up stream only (Lo-CFM for position control and/or clean air wash without disruption of the printer or other mechanism.)
- 1b—is placed downstream only (Higher CFM for position control, drying or air wash where printer disruption is not a concern.)
- 2c—is placed both downstream and upstream—(Lo, Hi-CFM for initial position control and/or clean air wash with higher CFM for position control, drying or air wash where printer disruption is not a concern.)

2—As any above with Blower-manifold to supply air.

3.—As #1, #2 where two (or more) such endorsers are removably arrayed, properly spaced, along track with air-conduits on either side of track—especially with blank plates to cut-off air to unused air-inlets.

- 4a—Combine 1a, and/or 2, and/or 3
- 4b—Combine 1b, and/or 2, and/or 3.
- 4c—Combine 1c, and/or 2, and/or 3.
- 4d Add caps in manifold.

5—Methods per above.

Other Variations:

One can use just an upstream, Lo-CFM air-injector (e.g., stream only to reduce dust build-up; or also to push document away from wall, nozzles etc., vs. Snag, and to help space documents from nozzles);

An "upstream-only" air injector is feasible if there were no room for a downstream injector. It would not have to be restricted to low CFM if the application was not concerned with print disruption. It could also be under program control for switching from high to low CFM when a printer was turned on.

The low CFM upstream injector's effects are enhanced by the addition of a downstream high CFM injector (and vice-versa). The injection of air on the downstream side pulls air from upstream of the injector and this extends the effectiveness of the upstream air system. This allows the upstream air to be a lower CFM than would be required if there was only an upstream injector.

One can use a downstream, hi CFM, flow injector by itself—e.g., to avoid wall contact, smear, etc. to accelerate drying or if no room for a second injector.

For a given design, variations in document size and weight change the degree of control the air system has over the document position. The greater the variation, the less control.

For instance, for the instant preferred system, designed for the NDP575, the documents can range from 18# (Light Recycled paper) to 90# (Card Stock) in weight, and document size can vary from 4,575"×2.5" to 10"×4".

The air system is most effective on light weight paper which is traditionally the most difficult to handle.

In conclusion, it will be understood that the preferred embodiments described herein are only exemplary, and that the invention is capable of many modifications and variations in construction, arrangement and use without departing from the spirit of the claims.

For example, the means and methods disclosed herein are also applicable to other related sheet imprint systems. Also, the present invention is applicable for enhancing other forms of jet printing/document handling.

The above examples of possible variations of the present invention are merely illustrative. Accordingly, the present invention is to be considered as including all possible modifications and variations coming within the scope of the invention as defined by the appended claims.

What is claimed is:

1. A document-endorse arrangement having a document transport mechanism wherein documents are advanced down a track past one or more print stations where a jet-print nozzle array projects an ink stream thereat, comprising one or more angled air streams arising from said track wherein each said air stream is directed downstream of said track at an acute angle of approximately 20 degrees with respect thereto, at least one of said airstreams being upstream of said nozzles, said upstream airstream adapted to pneumatically float each said document past said nozzles so as to maintain a prescribed zap between said document and both said track and said nozzles, thereby to inhibit contamination of said nozzle from surplus ink and dust.

2. The invention of claim 1 wherein said track is for "value documents" such as checks about to 5 to 15 mils thick and is about 10 to 12 mils wide.

3. The invention of claim 1 wherein said director means is set to keep said documents a minimum gap from said nozzles, according to the type of printer.

4. The invention of claim 1 wherein nozzles are set at approximately a 20° angle away from said track.

5. The invention of claim 4 wherein a first air stream is disposed upstream of said nozzles.

6. The invention of claim 5 wherein said first air stream is arranged to inhibit migration of dust toward said nozzles, and to not upset ink-jet printing, thereby, while also pulling fresh ambient air into the track area.

7. The invention of claim 6 wherein an air stream is disposed upstream of each said nozzle array plus a second air stream is disposed downstream of each said nozzle array, each first air stream supplying low CFM air and each second air stream supplying higher-CFM.

8. The invention of claim 1 wherein said airstream is directed so as to increase flow velocity, and decrease pressure on the near-side of each document, while standing-off the document from touching track walls or nozzles.

9. The invention of claim 8 wherein each nozzle array has a wall-crack located near.

10. The invention of claim 9 wherein upstream jet velocity is set low enough to avoid misdirecting ink-jet drops.

11. The invention of claim 10 wherein a first air stream is disposed upstream of each said nozzle array plus a second air stream is disposed downstream of each said nozzle array, each first air stream supplying low CFM air and each second air stream supplying higher-CFM.

12. The invention of claim 11 where said Hi CFM air stream downstream keeps a "wet document" from touching anything and "smearing".

13. The invention of claim 12 also including drive means and associated document detect means, disposed upstream of said nozzles plus second drive means and associated document detect means disposed downstream thereof.

14. The invention of claim 13 in association with one or more pairs of jet print stations, each station having an associated pair of up/down air steams, with each station in a pair on opposite sides of said track.

15. The invention of claim 14 wherein each jet print station in a pair is adapted to be located on either of the track, and has blankplates to shut-off air streams when an air stream is switched to the other side of the track.

16. The invention of claim 15 also including blower means to generate compressed air for all said air streams plus associated manifold means for distributing blower air to each pair of air streams at each said station.

* * * * *